US009411311B2

(12) United States Patent
Wyssbrod et al.

(10) Patent No.: US 9,411,311 B2
(45) Date of Patent: Aug. 9, 2016

(54) DEVICE FOR DRIVING AN ANALOGUE INDICATOR, PARTICULARLY A DATE RING

(71) Applicant: ETA SA Manufacture Horlogere Suisse, Grenchen (CH)

(72) Inventors: Baptist Wyssbrod, Nidau (CH); Julien Christan, Bienne (CH)

(73) Assignee: ETA SA Manufacture Horlogere Suisse, Grenchen (CH)

( * ) Notice: Subject to any disclaimer, the term of this patent is extended or adjusted under 35 U.S.C. 154(b) by 0 days.

(21) Appl. No.: 14/637,836

(22) Filed: Mar. 4, 2015

(65) Prior Publication Data

US 2015/0253732 A1 Sep. 10, 2015

(30) Foreign Application Priority Data

Mar. 10, 2014 (EP) ..... 14158625

(51) Int. Cl.
*G04B 13/02* (2006.01)
*G04C 17/00* (2006.01)

(52) U.S. Cl.
CPC ..... *G04B 13/02* (2013.01); *G04C 17/0066* (2013.01)

(58) Field of Classification Search
CPC ..... G04C 17/0058; G04C 17/005; G04C 17/0066; G04B 19/02; G04B 13/02
USPC ..... 368/37
See application file for complete search history.

(56) References Cited

U.S. PATENT DOCUMENTS 3,704,583 A 12/1972 Dome
3,738,097 A * 6/1973 Vuilleumier ..... G04B 19/25366 368/37
4,050,233 A * 9/1977 Ingenieur ..... 368/35

(Continued)

FOREIGN PATENT DOCUMENTS

| | | |
|---|---|---|
| FR | 2 124 471 | 9/1972 |
| GB | 2 205 181 | 11/1988 |
| JP | 60-173491 | 9/1985 |

OTHER PUBLICATIONS

European Search Report issued Nov. 6, 2014 in European Application 14158625, filed on Mar. 10, 2014 (with English Translation).

*Primary Examiner* — Sean Kayes
(74) *Attorney, Agent, or Firm* — Oblon, McClelland, Maier & Neustadt, L.L.P.

(57) ABSTRACT

The timepiece movement is fitted with an analogue indicator (6), particularly a date ring including a toothing (18) mechanically coupled to a drive device, which includes a motor and a drive wheel and pinion (8) and a support for the drive wheel and pinion. This support is pivotally mounted on a main plate about a first axis and it defines a second axis, remote from the first axis, about which the drive wheel and pinion is rotatably mounted. The drive device further includes a strip spring (40) exerting a force on the support such that the meshing means of the drive wheel and pinion press against the toothing of the analogue indicator. The meshing means and the toothing have respective profiles selected such that, at least in a plurality of distinct display positions of the analogue indicator, the drive wheel and pinion and the analogue indicator mesh with each other with substantially no play under the action of the strip spring.

13 Claims, 2 Drawing Sheets

(56) References Cited

U.S. PATENT DOCUMENTS 4,171,610 A * 10/1979 Gilomen ..... G04B 19/25386 368/38
4,198,808 A 4/1980 Tamaru
4,234,943 A * 11/1980 Teramoto et al. ..... 368/35
4,837,755 A 6/1989 Besson
5,187,693 A * 2/1993 Besson ..... 368/35

* cited by examiner

DEVICE FOR DRIVING AN ANALOGUE INDICATOR, PARTICULARLY A DATE RING

This application claims priority from European Patent application 14158625.5 of Mar. 10, 2014, the entire disclosure of which is hereby incorporated herein by reference.

FIELD OF THE INVENTION

The present invention concerns the field of timepiece movements having an analogue display. In particular, the invention concerns a device for driving an analogue indicator, particularly a date ring.

BACKGROUND OF THE INVENTION

Various analogue indicator drive devices are known to those skilled in the art. A known problem of analogue indicators arises from the fact that they are driven by a drive device that generally includes intermediate elements between a motor and the analogue indicator. In the case where there are provided distinct stationary display positions for a certain duration, given manufacturing tolerances and the play required between the various elements of the drive device, precise positioning of the indicator is not guaranteed without position maintaining means.

In the case of date display devices, the positioning of the indicator in the distinct display positions is generally ensured by a jumper spring associated with the date ring toothing. Conventional drive systems do not ensure sufficient locking of the date ring in the event of a shock. It is therefore the jumper spring which has to ensure this locking function, which is why it has a high elastic constant. Thus, to overcome the elastic force of the jumper spring, it is necessary to provide high torque at the date ring, which is a problem given the generally large reduction ratio? between the motor and the date ring.

SUMMARY OF THE INVENTION

It is an object of the present invention to provide a device for driving an analogue indicator, particularly a date ring, which can ensure precise positioning of the indicator without requiring a positioning jumper spring. It is another object of the invention to provide a drive device of this type which is resistant to shocks.

To this end, the present invention concerns a timepiece movement provided with an analogue indicator of a plurality of distinct data which is arranged for this purpose to be held stationary at least temporarily in any one position of a plurality of distinct display positions, this analogue indicator having a toothing mechanically coupled to a drive device. The drive device includes a motor, a drive wheel and pinion provided with means for meshing with the toothing and a support on which the drive wheel and pinion is mounted. The drive wheel and pinion support is mounted on a base in order to pivot about a first axis and the drive wheel and pinion is rotatably mounted on the support about a second axis distinct from the first axis. The drive device further includes an elastic means exerting a lateral force on the support so that the meshing means of the drive wheel and pinion press against the toothing of the analogue indicator, the meshing means and the toothing having respective profiles selected such that, at least in said plurality of distinct display positions of the analogue indicator, the drive wheel and pinion and the analogue indicator mesh with each other with substantially no tangential play under the action of the elastic means.

In a variant, the elastic means is formed by a strip spring which presses laterally against the drive wheel and pinion support.

Other particular features of the invention will be set out below in the detailed description of the invention.

BRIEF DESCRIPTION OF THE DRAWINGS

The invention will be described below with reference to the annexed drawings, given by way of non-limiting example, and in which.

DETAILED DESCRIPTION OF THE INVENTION

Figure 1:
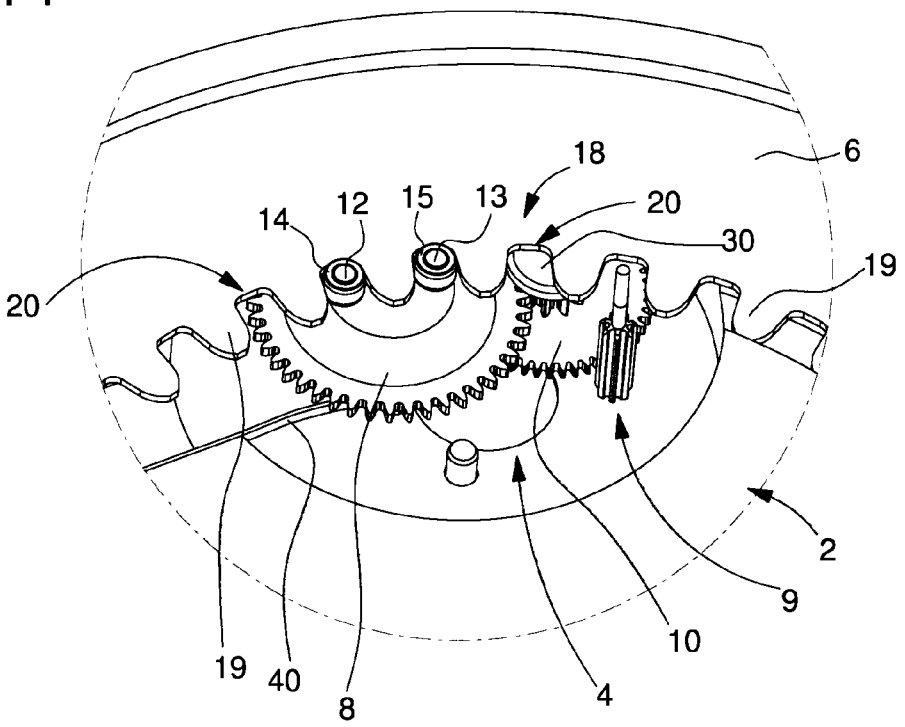
FIG. 1 shows an embodiment of a timepiece movement according to the invention and more specifically the device for driving a date ring.
Figure 2:
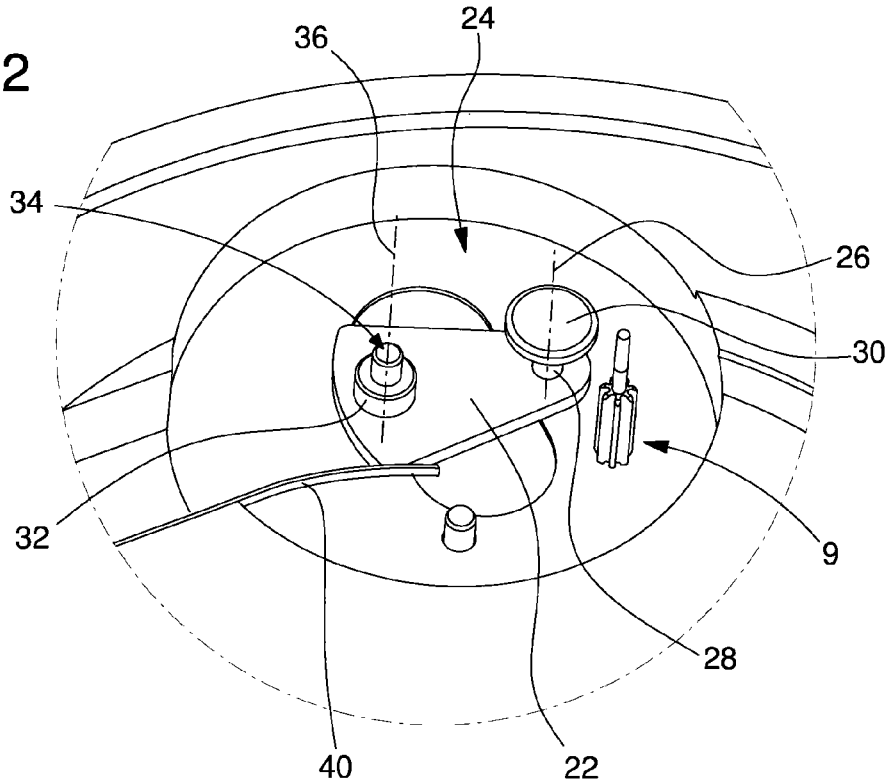
FIG. 2 shows certain elements of the drive device of FIG. 1.
Figure 3:
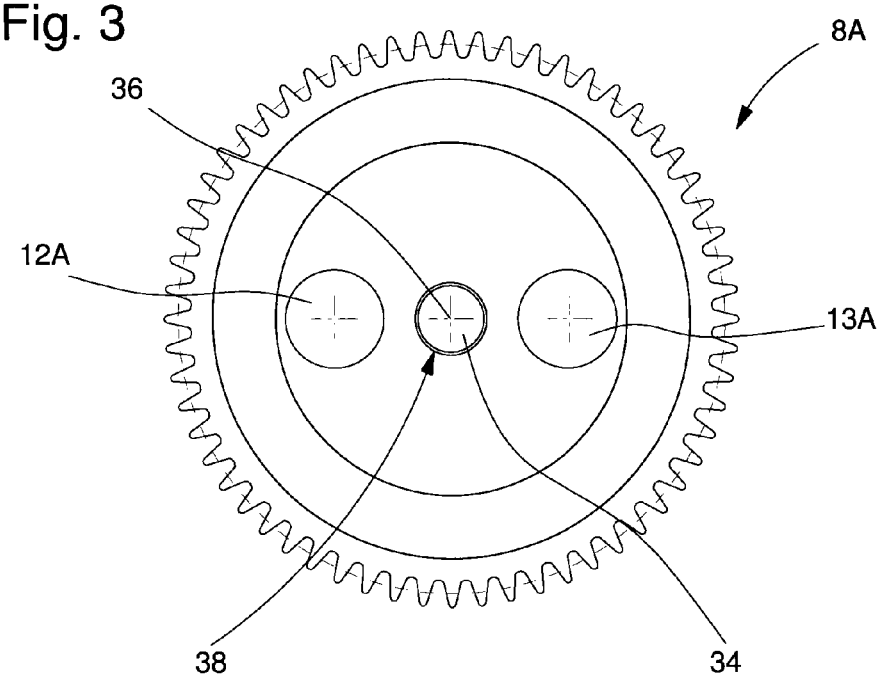
FIG. 3 is a top view of a variant of the date ring drive wheel and pinion of the first embodiment.

With reference to FIGS. 1 to 3, there will be described hereafter an embodiment of a timepiece movement 2 provided with a drive device 4 for a date ring 6 according to the invention. The drive device includes a motor, of which only the pinion of the rotor 9 is shown in the Figures, an intermediate wheel 10 and a wheel 8 or 8A driving the date ring. It will be noted that, in a first variant, the motor is a mechanical motor of the barrel type, whereas in another variant there is provided an electromechanical timepiece motor. Intermediate wheel 10 is arranged between rotor 9 of the motor and the drive wheel, with its pinion meshing with the drive wheel.

Drive wheel 8 or 8A is provided with only two pins, which rise from the central portion of the wheel and which are aligned with the axis of rotation of the drive wheel and diametrically opposite. These two pins form means for meshing the drive wheel with the inner toothing 18 of the date ring. In the variant of FIG. 1, the two pins 12 and 13 are respectively provided with two roller bearings 14 and 15. In the variant of FIG. 3, the two pins 12A and 13A do not have roller bearings. The term "meshing means" is understood to signify means of mechanical coupling between the date ring and the drive wheel. Thus, the meshing means are formed here on the one hand of the two pins, in this case provided with their respective roller bearings, and on the other hand of inner date ring toothing 18.

Drive wheel 8 or 8A is mounted on a support 22 which has a fixed pivot 34 arranged on a base 32 of larger diameter, this base defining a stop member on which the drive wheel rests. The fixed pivot defines the axis of rotation 36 of the drive wheel which has a central hole 38 into which the fixed pivot is inserted. According to the invention, the support is mounted on a main plate 24 and pivots about a pivot axis 26 which is defined by an arbor 28 traversing the support. Axis of rotation 36 is remote from pivot axis 26 so that the axis of the drive wheel follows an arc of a circle when the support pivots. Intermediate wheel 10 is also mounted on pivoting support 22 and its axis of rotation is merged with pivot axis 26 of the support. Thus, the axis of rotation of the intermediate wheel remains fixed relative to main plate 24 when support 22 pivots, which ensures the coupling to rotor 9 of the motor regardless of the angular position of the support.

Given that the date ring passes partially above the drive wheel and the intermediate wheel, the drive wheel is maintained in position axially by the date ring and the intermediate wheel is maintained in position axially by a button 30 forming a stop member. For the button to be able to be underneath the date ring, the central portion of the drive wheel has a truncated cone shape. This makes it possible to obtain a difference in level between the drive wheel toothing and the two drive wheel pins and therefore to provide a space for the button above the intermediate wheel pinion.

The drive device further includes a strip spring 40 which exerts a lateral force on support 22 so that the two pins press laterally on the date ring toothing 18 towards the bottom of the toothing. The strip spring is in tension and is pressed against a lateral surface of support 22 so as to exert a torque force thereon. Other types of spring or other alternative elastic means providing the torque force necessary for the given function may be provided by those skilled in the art. The date ring toothing has a profile with teeth 19 having hollows 20 between them, this profile being arranged to cooperate with the two pins, or, where appropriate, the two roller bearings so that, when the two pins (with or without roller bearings) are in a tangential orientation relative to the date ring, the drive wheel and the date ring mesh with each other with substantially no tangential play under the action of strip spring 40. In FIG. 1, hollows 20 are provided in order to house pins 12 and 13 provided with their roller bearings with very little tangential play when the two roller bearings press against the bottom of the toothing, that is to say against the bottom of hollows 20 here.

It is provided that the distinct display positions of the analogue indicator, here the date ring positions corresponding to the display of different dates in an aperture in a dial intended for the timepiece movement according to the invention, correspond to a tangential orientation of the two date wheel pins. Thus, the drive device according to the invention ensures both the driving of the date ring and the precise positioning thereof in the different date display positions. Moreover, especially in the preferred embodiment with a drive wheel provided with two pins which are aligned with the axis of rotation of the drive wheel, the drive device also forms a very effective shock resistant system. Indeed, when a shock produces a torque force on the date ring, the drive wheel exerts a reaction force which maintains the date ring in position.

It will be noted that, in another less effective embodiment as regards the shock resistant function, the drive wheel has more than two pins, particularly three or four, arranged in an equidistant manner on a circle whose centre is the axis of rotation of the drive wheel. These pins may also be provided, in a variant, with roller bearings. Apart from this difference, and thus the fact that moving the date ring forward through an angular distance corresponding to one tooth is obtained with a smaller rotation of the drive wheel than in the case described above with two pins, the drive device is similar to the embodiment described with reference to FIGS. 1 to 3.

Figure 4:
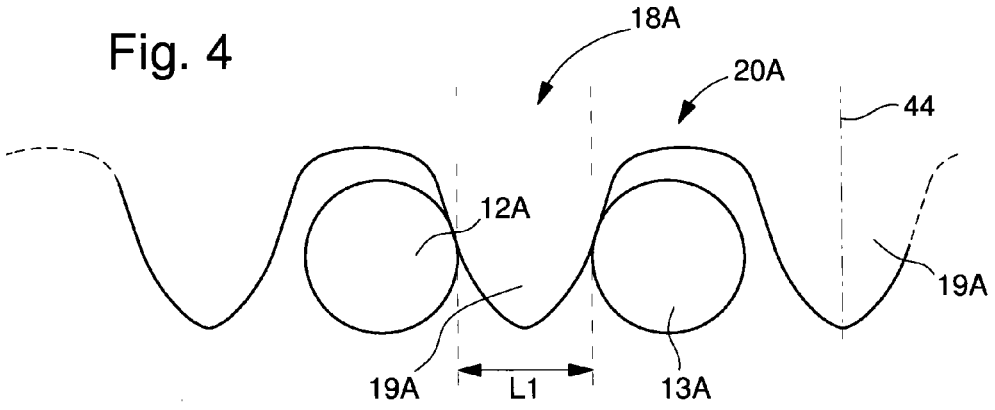
FIG. 4 shows a first advantageous embodiment of the meshing between the date disc toothing and the drive wheel and pinion in a date display position.
Figure 5:
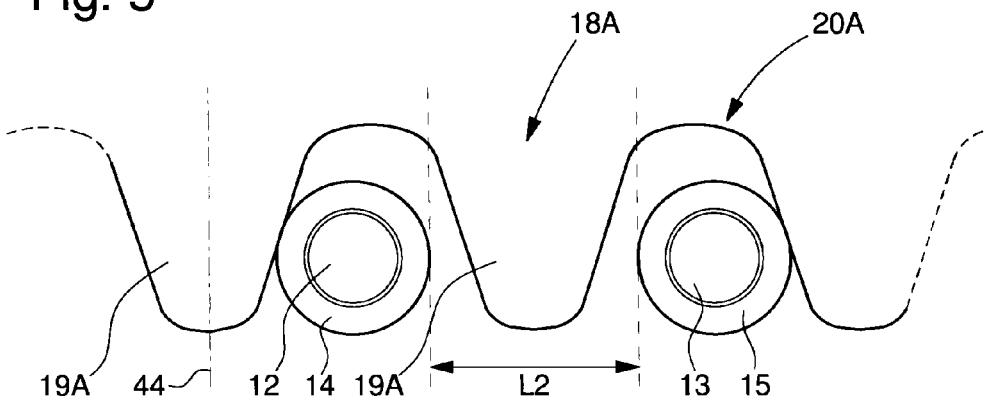
FIG. 5 shows a second advantageous variant of the meshing between the date disc toothing and the drive wheel and pinion in a date display position.

FIGS. 4 and 5 show two variants of the association between a profile of date ring toothing 18A and two adjacent pins meshing with toothing 18A. Teeth 19A of the toothing have non parallel flanks each defining a monotonically increasing curve relative to central axis 44 of the corresponding tooth towards the bottom of the toothing. The distance L1 between the two pins 12A and 13A or, where appropriate, the distance L2 between the two respective roller bearings 14 and 15, is arranged, in the date ring display positions, to have two points of contact between the two pins or, where appropriate, between the two respective roller bearings, and respectively two flanks of one tooth (FIG. 4) or of two teeth having an intermediate tooth between them (FIG. 5), without touching the bottom of the toothing. These variants are particularly advantageous since, in cooperation with strip spring 40, the arrangement of the toothing and the space between the pins are such that there is no longer any tangential play when the two pins have a tangential orientation, as shown in FIGS. 4 and 5. It will be noted that this characteristic is obtained despite the usual manufacturing tolerances. Indeed, the only effect of these tolerances will be a greater or lesser penetration of the pins in the date ring toothing. The mean angular opening defined by the teeth flanks and the depth of the toothing are selected such that, throughout the range of tolerance (i.e. the various cumulative tolerances), the pins or, where appropriate, the roller bearings, do not abut the bottom of the toothing hollows 20A.

Finally, in an embodiment in which the motor is an electromagnetic motor, the timepiece movement includes a control unit arranged to drive the electromagnetic motor, preferably in an accelerated mode, during the change from one display position to the next display position of the date ring. Thus, the transitional periods are of short duration, which limits the risk of a shock during rotation of the drive wheel. Indeed, when the two pins are in a substantially radial position relative to the date ring, a moment of force exerted on the ring generates a moment of force on the drive wheel which has only one pin in the toothing.

The invention claimed is:

1. A timepiece movement fined with an analogue indicator of a plurality of distinct data which is arranged to be held stationary at least temporarily in any one position of a plurality of distinct display positions, said analogue indicator including a toothing mechanically coupled to a drive device including a motor and a drive wheel and pinion provided with a meshing mechanism to mesh with the toothing, said drive device further including a support on which the drive wheel and pinion is mounted, said meshing mechanism formed by two pins which rise from said drive wheel and pinion, wherein said support is mounted on a base in order to pivot about a first axis and said drive wheel and pinion is rotatably mounted on said support about a second axis distinct from the first axis, said drive device further including an elastic mechanism applying a lateral force to said support so that said meshing mechanism of the drive wheel and pinion press against the analogue indicator toothing, said meshing mechanism and the toothing including respective profiles selected such that, at least in said plurality of distinct display positions of the analogue indicator, the drive wheel and pinion and the analogue indicator mesh with each other with substantially no tangential play under the action of said elastic mechanism once each of the two ins comes in contact with the toothing.

2. The timepiece movement according to claim 1, wherein the drive device further includes an intermediate wheel which is arranged between the motor and the drive wheel and pinion and which meshes with said drive wheel and pinion, said intermediate wheel being mounted on said pivoting support and including an axis of rotation that merges with said first pivot axis of said support.

3. The timepiece movement according to claim 1, wherein said analogue indicator is a date ring and said toothing is an inner toothing of said date ring.

4. The timepiece movement according to claim 1, wherein said meshing mechanism are formed by at least three pins which rise from the drive wheel and pinion.

5. The timepiece movement according to claim 4, wherein the pins are each provided with a roller bearing.

6. The timepiece movement according to claim 4, wherein teeth of said toothing have non-parallel flanks each defining a monotonically increasing curve relative to a central axis of the corresponding tooth towards a bottom of said toothing, and wherein a distance between two adjacent pins, where appropriate between two respective roller bearings, is arranged, in said plurality of distinct display positions of the analogue indicator, to have two points of contact between the two adjacent pins or, where appropriate, between the two respective roller bearings and respectively two flanks of a tooth, without touching the bottom of the toothing.

7. The timepiece movement according to claim 4, wherein teeth of said toothing have non-parallel flanks each defining a monotonically increasing curve relative to a central axis of the corresponding tooth towards a bottom of said toothing, and wherein a distance between two adjacent pins, where appropriate between two respective roller bearings, is arranged, in said plurality of distinct display positions of the analogue indicator, to have two points of contact between the two adjacent pins or, where appropriate, between the two respective roller bearings and respectively two flanks of two teeth, including between them an intermediate tooth, without touching the bottom of the toothing.

8. The timepiece movement according to claim 1, wherein said meshing mechanism are formed by only two pins which rise from said drive wheel and pinion, said two pins being aligned with the axis of rotation of said drive wheel and pinion and diametrically opposite.

9. The timepiece movement according to claim 8, wherein the two pins are each provided with a roller bearing.

10. The timepiece movement according to claim 8, wherein teeth of said toothing have non-parallel flanks each defining a monotonically increasing curve relative to a central axis of the corresponding tooth towards a bottom of said toothing, and wherein a distance between the two pins, where appropriate between the two respective roller bearings, is arranged, in said plurality of distinct display positions of the analogue indicator, to have two points of contact between the two pins or, where appropriate, between the two respective roller bearings and respectively two flanks of a tooth, without touching the bottom of the toothing.

11. The timepiece movement according to claim 8, wherein teeth of said toothing have non-parallel flanks each defining a monotonically increasing curve relative to a central axis of the corresponding tooth towards a bottom of said toothing and wherein a distance between the two pins, where appropriate between the two respective roller bearings, is arranged, in said plurality of distinct display positions of the analogue indicator, to have two points of contact between the two pins or, where appropriate, between the two respective roller bearings and respectively two respective flanks of two teeth, including between them an intermediate tooth, without touching the bottom of the toothing.

12. The timepiece movement according to claim 1, wherein said motor is an electromagnetic motor, and wherein said timepiece movement includes a control unit arranged to drive said electromagnetic motor n an accelerated mode during the change from one distinct display position to a following distinct display position.

13. The timepiece movement according to claim 1, wherein said elastic mechanism applying a lateral force to said support is formed by a strip spring.

* * * * *